US005103794A

United States Patent [19]

Shiraishi

[11] Patent Number: 5,103,794

[45] Date of Patent: Apr. 14, 1992

[54] CONTROL SYSTEM FOR INTERNAL COMBUSTION ENGINE

[75] Inventor: Takashi Shiraishi, Ibaraki, Japan

[73] Assignee: Hitachi, Ltd., Tokyo, Japan

[21] Appl. No.: 551,301

[22] Filed: Jul. 12, 1990

[30] Foreign Application Priority Data

Jul. 14, 1989 [JP] Japan ..... 1-180358

[51] Int. Cl.[5] ..... F02M 33/02

[52] U.S. Cl. ..... 123/520; 123/516

[58] Field of Search ..... 123/519, 520, 521, 518, 123/516

[56] References Cited

U.S. PATENT DOCUMENTS

| | | | |
|---|---|---|---|
| 3,680,318 | 8/1972 | Nakajima | 123/519 |
| 4,127,097 | 11/1978 | Takimoto | 123/520 |
| 4,527,532 | 7/1985 | Kasai | 123/520 |
| 4,530,210 | 7/1985 | Yamazaki | 123/520 |
| 4,700,683 | 10/1987 | Uranishi | 123/519 |
| 4,817,576 | 4/1989 | Abe | 123/519 |
| 4,951,643 | 8/1990 | Sato | 123/520 |
| 4,986,070 | 1/1991 | Abe | 123/520 |

FOREIGN PATENT DOCUMENTS

| | | | |
|---|---|---|---|
| 62-131962 | 6/1987 | Japan | 123/520 |

*Primary Examiner*—Carl Stuart Miller

*Attorney, Agent, or Firm*—Antonelli, Terry, Stout & Kraus

[57] ABSTRACT

An evaporative emission of the fuel in a fuel tank is introduced to a cylinder of the engine through two evaporative fuel routes to burn the evaporative fuel. In this system, a control valve provided in one of the evaporative fuel routes is controlled based on a control state of a control valve provided in the other evaporative fuel route.

12 Claims, 7 Drawing Sheets

CONTROL SYSTEM FOR INTERNAL COMBUSTION ENGINE

BACKGROUND OF THE INVENTION

The present invention relates to a control system for an internal combustion engine having a plurality of evaporative fuel paths.

Generally, a car has a fuel tank for storing fuel. Within the fuel tank, the fuel is evaporated to generate evaporative emission.

If the evaporative emission is discharged in the atmosphere, it will cause air pollution. Therefore, the evaporative emission is introduced into the air intake path through evaporative fuel paths or routes. The evaporative fuel is further discharged into the cylinders of the internal combustion engine for combustion.

By controlling the fuel flow in the internal combustion engine, the quantity of the fuel supplied from a fuel supplying device, such as a fuel injector or the like, is controlled so that an air-to-fuel ratio is held near a target air-fuel ratio.

In the conventional system, there is a problem that the air-fuel ratio of the mixture to be burned in the cylinder deviates greatly from the target value due to discharging of the evaporative fuel into the cylinder from the fuel tank or the charcoal canister.

It is an object of the present invention to provide a control unit for an internal combustion engine which can promptly burn the evaporative fuel generated in the fuel tank and which can minimize the influence of the evaporative emission on the control of the air-fuel ratio.

SUMMARY OF THE INVENTION

In order to achieve the above object, the control unit of the present invention comprises a fuel tank, at least a first and a second evaporative fuel routes for passing an evaporative fuel in the fuel tank to the intake air path, a first and a second control valves provided in the first and second evaporative fuel routes for controlling the quantity of the evaporative fuel passing therethough, first control quantity determination unit for determining a first control quantity for controlling the first control valve based on an operation state of the engine, and second control quantity determination unit for determining a second control quantity for controlling the second control valve based on said first control quantity.

In accordance with the above-described configuration of the present invention, the evaporative fuel is discharged by relating the quantity of the fuel flow to the engine in operation, so that the exhaust emission can be controlled and, further, the evaporative fuel can be treated promptly.

Further, the present invention provides the following effects in a first embodiment (FIGS. 3 and 4) and a second embodiment (FIGS. 5 and 6) which are described in detail below. Namely, the supply of an evaporative fuel from the evaporative fuel routes can be made most efficient to meet the operation state of the engine. Therefore, the influence of the evaporative emission from the first evaporative fuel route to an air-fuel ratio can be restricted by controlling the evaporative emission from the second fuel supply route.

DESCRIPTION OF THE PREFERRED EMBODIMENTS

An embodiment of the present invention will be described below with reference to the drawings.

Figure 1:
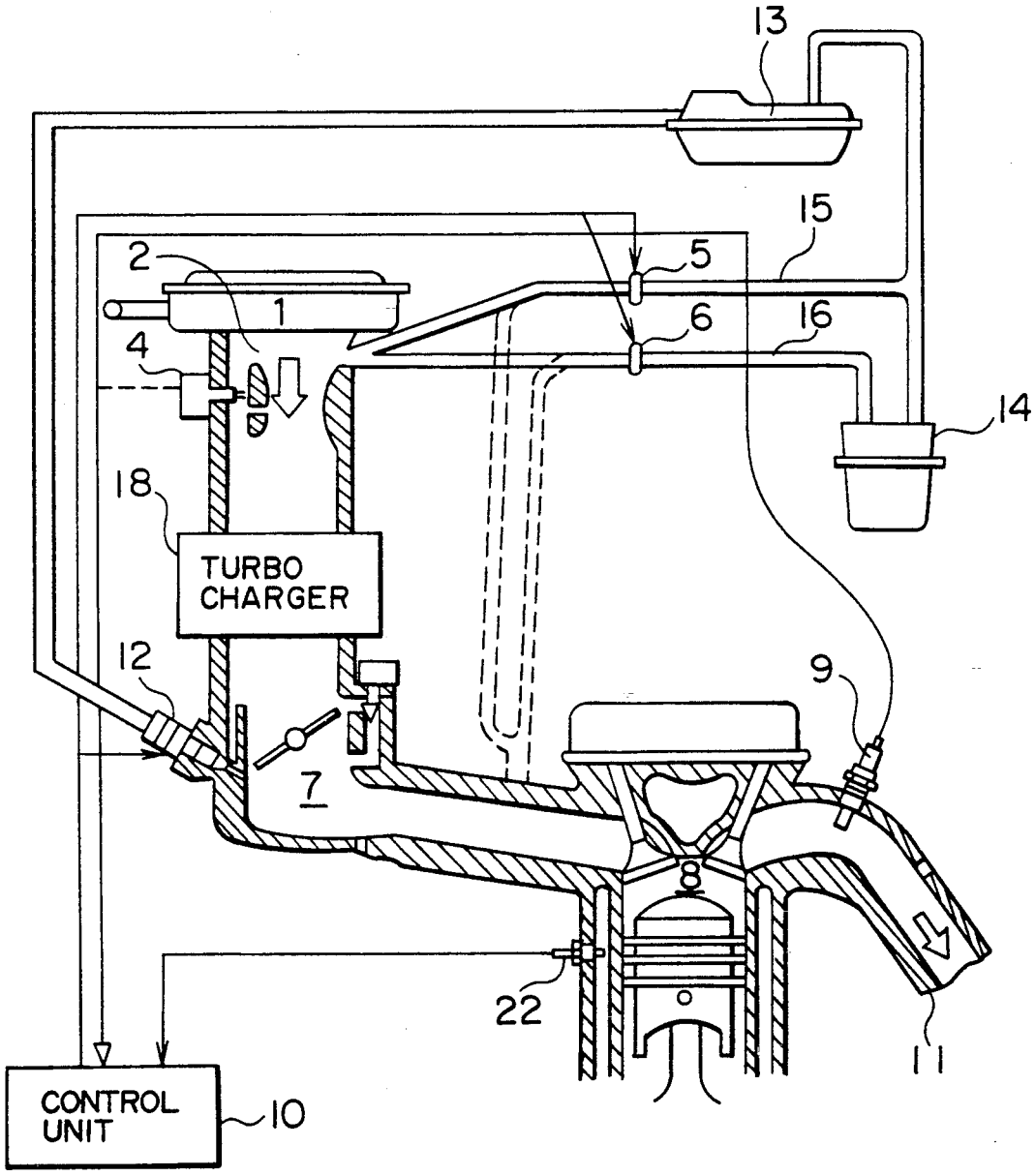
FIG. 1 is a configuration diagram of the system of the present invention.

FIG. 1 shows a configuration diagram of the system according to the present invention. In FIG. 1, air is taken into an air cleaner 1, compressed by a turbo charger 18, and passed to a cylinder 8 through an air intake pipe 7. Quantity of the suctioned air is controlled by a throttle valve 3. The quantity of the air flow is detected by an air flow sensor 4 and is outputted to an input of a control unit 10.

In the meantime, fuel is guided from a fuel tank 13 and is supplied to the air intake pipe 7 by an injector 12. An evaporative emission generated in the fuel tank 13 is supplied to the upstream of the turbo charger through a control valve 5 provided in an evaporative fuel pipe 15. The evaporative fuel is then temporarily stored in a charcoal canister 14 and is similarly discharged to the upstream of the turbo charger through a control valve 5 provided in an evaporative fuel pipe 16.

In a system which has no turbo charger, on the other hand, an evaporative fuel is discharged to the downstream of the throttle valve 7, as shown by dotted lines.

The fuel supplied from the fuel injection valve 12 from the intake manifold 7 is mixed with an intake air to form mixture which is supplied to the cylinder 8. The mixture is compressed and ignited, and then discharged in the atmosphere from an exhaust gas pipe 11. An exhaust gas sensor 9 is provided in the exhaust gas pipe 11 to detect oxygen concentration in the exhaust gas for determining the air-fuel ratio, and the detected air-fuel ratio is outputted to a control unit 10.

Figure 2:
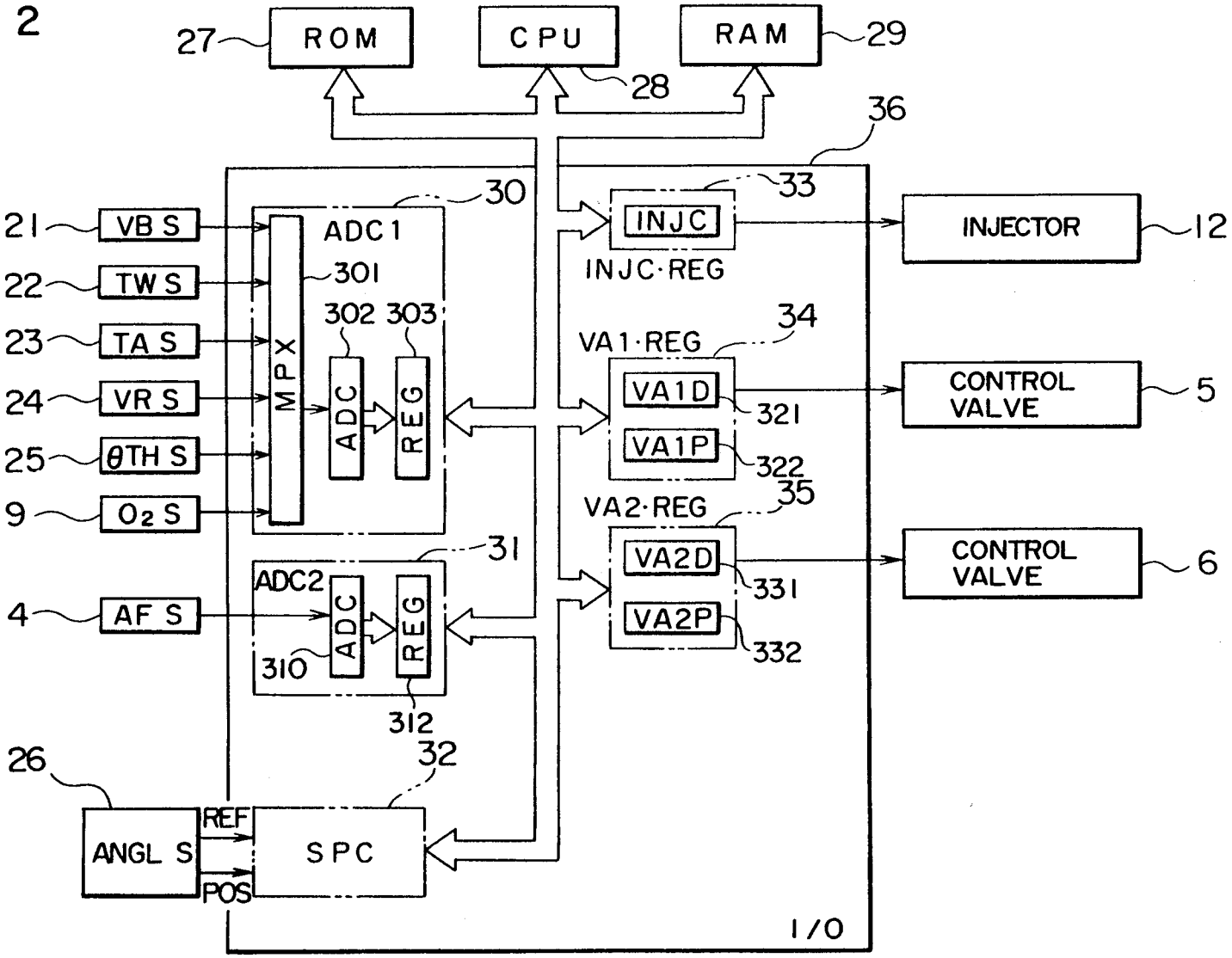
FIG. 2 is a block diagram showing the details of the control unit.

FIG. 2 is a block diagram for showing the details of the control unit 10, which comprises a ROM 27, a CPU 28, a RAM 29, and an I/O unit 36.

Outputs from a battery voltage sensor 21 for detecting a battery voltage, a cooling water temperature sensor 22 for detecting a temperature of the cooling water, an atmospheric temperature sensor 23 for detecting an atmospheric temperature, a set-value detection sensor 24 for detecting a resistance value of a variable resistance for determining a set value of an idling speed, a throttle opening sensor 25 for detecting an opening of the throttle value 3 and the exhaust gas sensor 9, are applied to the CPU 28 through input circuits 30 and 31.

Outputs from the sensors 21 to 25 and 9 are selected by a multiplexer 301, converted into digital values by an A/D converter 302, and are held in a register 303. An output from the air-intake quantity sensor 4 is converted into a digital value by an A/D converter 310, and is held in a register 312. A crank angle sensor 26 generates an air cylinder signal (REF) and an angle signal (POS). An output from the crank angle sensor 26 is applied to the CPU 28 through a pulse wave shaping circuit 32. Based on a program stored in the ROM 27, the CPU 28 reads information from the I/O unit 36 and processes it. Temporary data for the processing is stored in the RAM 29.

Values of the data processed by the CPU 28 are set in an injector register 33, a valve-1 register 34 and a valve-2 register 35. Based on these processed values, the injector 12, the control valve 5 and the control valve 6 are controlled.

Both the valve registers 34 and 35 have registers 321 and 331 for holding a valve opening and closing cycle and registers 331 and 332 for holding a valve opening and closing duty value (opening period).

The CPU 28 feedback-controls the quantity of a fuel supplied from the injector 12 and maintains an air-fuel ratio at a target value, based on an output from the exhaust gas sensor 9.

Figure 3:
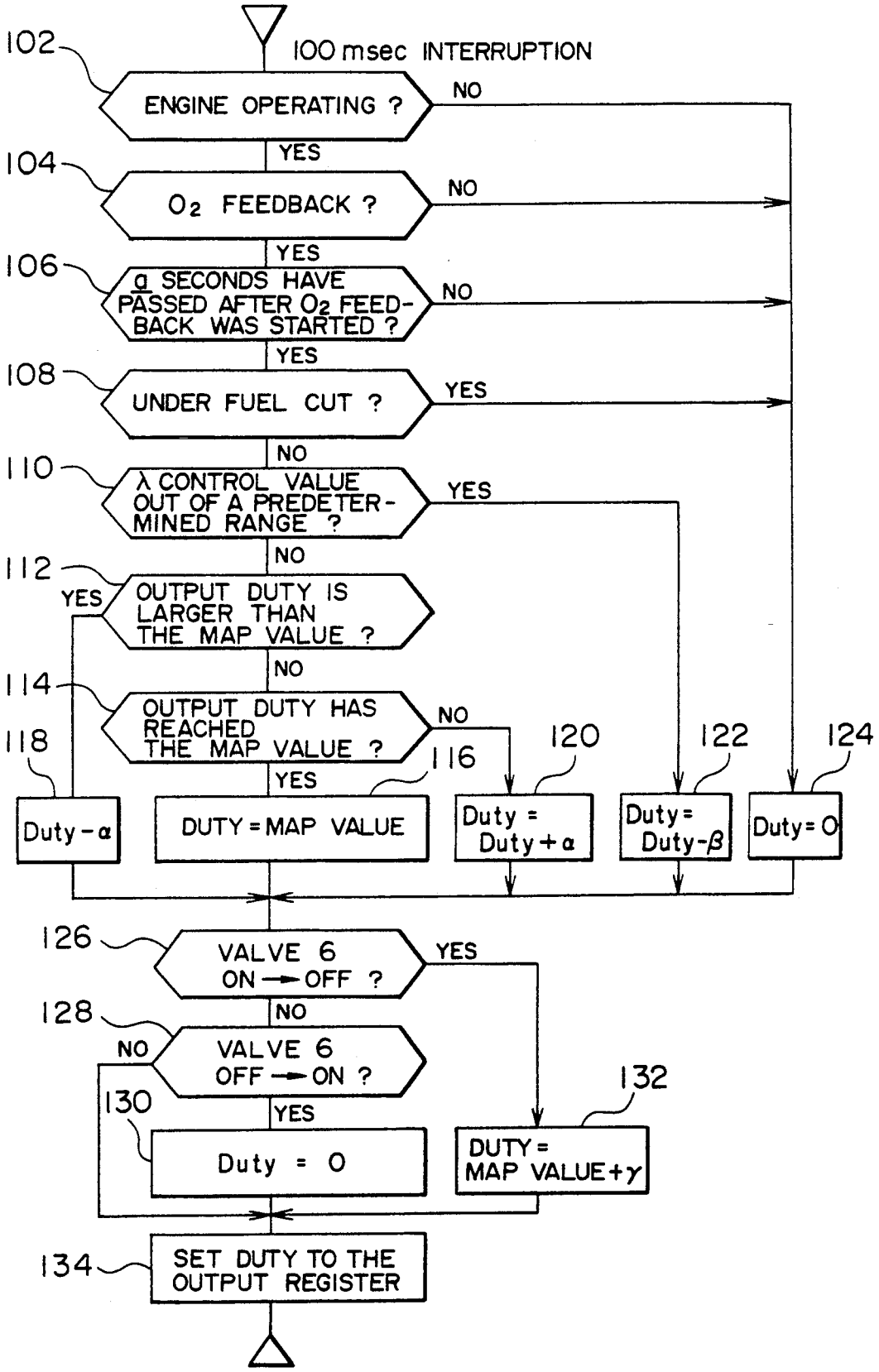
FIGS. 3 and 4 are flow chart diagrams for showing the operation of the first embodiment of the present invention.
Figure 4:
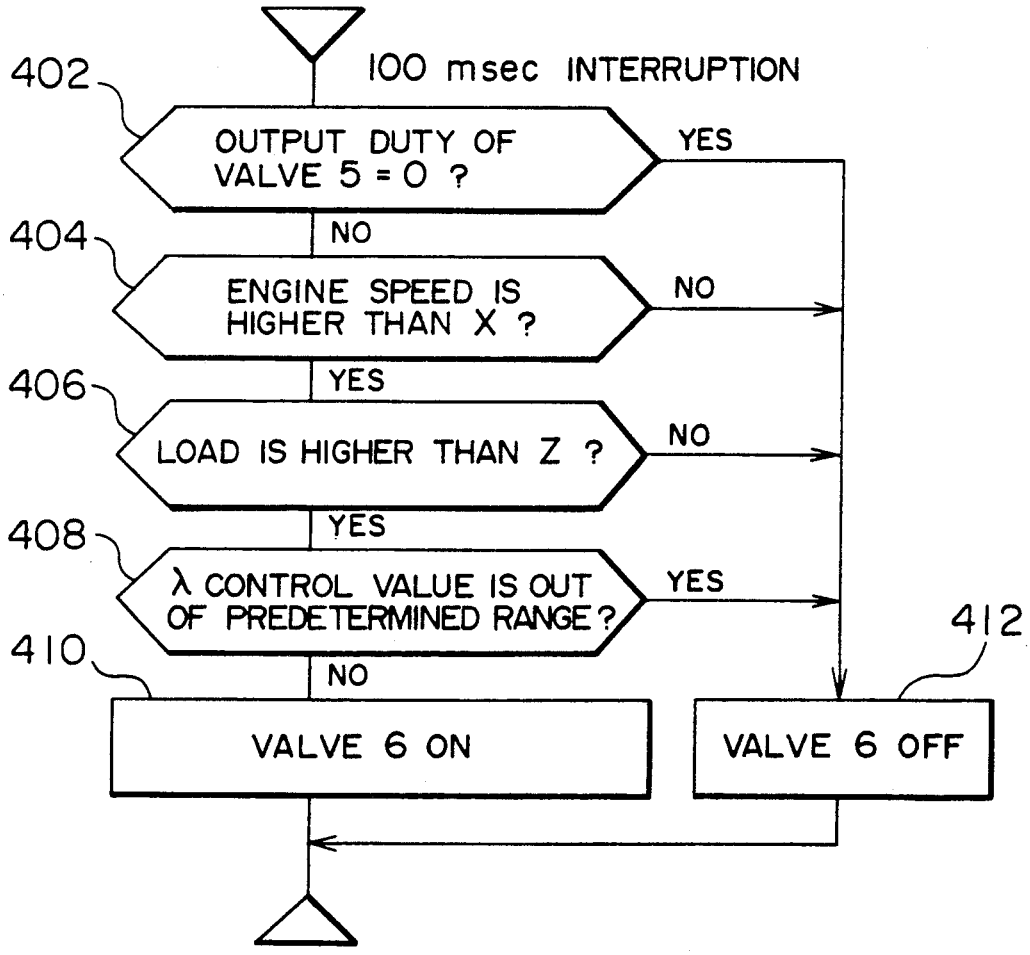

Contents of processing of the control valves 5 and 6 performed by the CPU 28 will be explained by using the flow charts shown in FIGS. 3 and 4. In the present embodiment, the control valve 5 is a pulse duty control valve, and the control valve 6 is an on-off control valve.

Description will first be made of the operation of the control valve 5 for controlling the evaporative emission of the fuel introduced from the fuel tank 13, with reference to the flow chart in FIG. 3. The control shown in this flow chart is executed at every 100 ms. First, decision is made whether the engine is operating or not in Step 102. If the evaporative fuel is discharged into the intake pipe when the engine is not operating, the fuel which remains without any combustion is stored in the cylinder, causing a problem of a difficulty in starting the engine. Therefore, when it is confirmed that the engine is not operating, a duty of the control valve 5 is set at zero so that the control valve 5 is in a closed state in Step 124. Once the duty is set at zero, an evaporative fuel is not guided from the fuel tank 13 to the inlet manifold 7. If it is confirmed that the engine is operating, the process proceeds to Step 104.

In step 104, a decision is made whether the $O_2$ feedback is well known for example disclosed by U.S. Pat. Nos. 4,483,300, 4,766,870 and 4,627,402. In the $O_2$ feedback control, the air-fuel ratio of the mixture is detected by the exhaust gas sensor 9, and the amount of the fuel flow and the intake air flow are controlled in feed-back method in response to the output of the exhaust gas sensor 9. Hereinafter, this feed-back control is represented by the $O_2$ feed-back control. When $O_2$ feed-back is not being carried out, the quantity of a fuel supply is determined by an open loop. In the open loop, an air-fuel ratio can not be controlled to maintain the target value when the evaporative fuel is discharged from the fuel tank 13 to the cylinder. When $O_2$ feedback is not being carried out, the duty of the control valve 5 is set at zero in Step 124. In other words, the control valve 5 is closed. If $O_2$ feedback is being carried out in Step 104, the process proceeds to Step 106.

In Step 106, a decision is made whether a predetermined time (a seconds) has passed or not since an $O_2$ feedback was started. If a predetermined time has not passed since the starting of an $O_2$ feedback, there is a possibility that the air-fuel ratio control according to the $O_2$ feedback does not function satisfactorily. If the evaporative fuel is discharged from the fuel tank in this state, the air-fuel ratio deviates from the target value further. Unless a predetermined time has passed since the starting of the $O_2$ feedback, the duty of the control valve 5 is set at zero in Step 124. If a predetermined time has passed since the starting of the $O_2$ feedback, the process proceeds to Step 108.

In Step 108, a decision is made whether the fuel supply is being cut or not. Such fuel-cut is carried out in a deceleration state. Since it is not necessary to discharge the evaporative fuel when the fuel-cut is being carried out, the duty of the control valve 5 is set at zero in Step 124. If the fuel-cut is not being carried out, the process proceeds to Step 110.

In Step 110, a decision is made whether a $\lambda$ control quantity which is a correction parameter of a fuel supply quantity relating to the $O_2$ feed-back control for maintaining ar. air-fuel ratio at a target air-fuel ratio based on an output of the exhaust gas sensor, is out of a predetermined range or not. If the $\lambda$ control quantity is not in a predetermined range, there is a possibility that there is too much quantity of the evaporative fuel being discharged from the fuel tank to perform a normal control of $O_2$ feedback. In this case, the duty of the control valve 5 is reduced by a predetermined quantity $\beta$ from the preceding duty thereby to control the control valve 5 to be closed in Step 122. If the $\lambda$ control value is not out of a predetermined range, the process proceeds to Step 112.

In Step 112, a decision is made whether an output duty is greater than an $M_{AP}$ value or not. As described later, the $M_{AP}$ value is determined based on an engine speed or an engine load which quantitatively indicates the state of the engine, so that the $M_{AP}$ value shows a duty of the control valve 5 in accordance with individual engine states. In Step 132, when the control valve 6 has been changed over from ON to OFF, the output duty is processed to have a higher value than the $M_{AP}$ value by a predetermined value of $\gamma$ to avoid an occurrence of a lean fuel ratio, as described later. If an output duty is greater than the $M_{AP}$ value, the duty is reduced by a predetermined value $\alpha$ from the preceding output duty to gradually return the duty to the $M_{AP}$ value thereby to close the control valve 5 in Step 118. If the output duty is not greater than the $M_{AP}$ value, the process proceeds to Step 114.

In Step 114, a decision is made whether the duty of the control valve 5 has reached the $M_{AP}$ value or not. The duty of the control valve 5 is set at zero in Step 124 and Step 132 to be described later. If the duty of the control valve 5 has not reached the $M_{AP}$ value, the preceding duty is added by a predetermined value $\alpha$ to gradually return the duty to the $M_{AP}$ value thereby to open the control valve 5 in Step 120. If the output duty has reached the MAP value, the duty of the control valve 5 is set at the $M_{AP}$ value in Step 116, and the process proceeds to Step 126. The $M_{AP}$ value is stored in advance in the ROM 27 in accordance with an engine speed and an engine load.

The predetermined values $\alpha$ and $\beta$ which relate to an increase and a decrease of a duty by an execution of the flow chart, are set as follows. That is, even if a quantity of a supply of the evaporative fuel has reached a maximum, a variation of an air-fuel ratio due to an increase or decrease of a duty becomes smaller than a variation of an air-fuel ratio due to an $O_2$ feedback. By setting the predetermined values $\alpha$ and $\beta$ in the manner as described above, it becomes possible to control an air-fuel ratio by an $O_2$ feedback regardless of a state of supplying the evaporative fuel.

Steps 126 to 132 show controls of the control valve 5 in accordance with an opening and a closing of the control valve 6. The control valve 6 will be explained later with reference to the flow chart in FIG. 4. In briefly explaining the operation of the control valve 6, it is ON and OFF controlled in accordance with a state of the engine. First, in Step 126, a decision is made whether the control valve 6 has been changed over from ON to OFF. When the control valve 6 has been changed over from ON to OFF, discharging of the evaporative fuel by the control valve 6 terminates so that an air-fuel ratio, which has been in balance so far, becomes unbalanced, causing a shortage of fuel, resulting in a lean fuel ratio. In order to avoid the lean fuel ratio of the mixture, in Step 132, the duty of the control valve 5 is increased by a predetermined value $\gamma$ to open the control valve 5 thereby to increase the quantity of the evaporative fuel passing through the control valve 5. In Step 134, the duty value determined in any one of Steps 116, 118, 120, 122, 124, 130 and 132 is set in register VAID of register VAl. Reg 34 shown in FIG. 2. Control valve 5 is controlled with the duty value set in the register. If the control valve 6 has not been changed over from ON to OFF in Step 126, the process proceeds to Step 128.

In Step 128, a decision is made whether the control valve 6 has been changed over from OFF to ON. When the control valve 6 has been changed over from OFF to ON, passing by the evaporative fuel by the control valve 6 is started so that an air-fuel ratio, which has been in balance so far, becomes unbalanced, resulting in over rich mixture. In order to prevent an occurrence of the over rich fuel ratio, the duty of the control valve 5 is set at zero thereby to stop the supply of the evaporative fuel by the control valve 5 in Step 130. Then, the process proceeds to Step 134. If the control valve 6 has not been changed over from OFF to ON in Step 128, the process proceeds to Step 134.

Last, in Step 134, a duty value obtained by the processing is set to a register 321 of the valve-1 register 34, thereby to terminate the execution of the flow.

Next, the operation of the control valve 6 will be explained with reference to the flow chart in FIG. 4. The operation shown in this flow chart is executed at every 100 msec.

First, in Step 402, a decision is made whether the duty of the control valve 5 is zero or not. When the duty of the control valve 5 is zero, the evaporative fuel should not be discharged in this state, so that the control valve 6 is closed so as not to discharge the evaporative fuel from the control valve 5 in Step 412, thus terminating the flow. When the duty of the control valve 5 is not zero, the process proceeds to Step 404.

In Step 404, a decision is made whether the engine speed is above a predetermined value x or not. If the engine speed is lower than X, even a small quantity of the evaporative fuel will affect an air-fuel ratio greatly, so that the control valve 6 is closed in Step 412, thus terminating the flow. If the engine speed is higher than the predetermined value X, the process proceeds to Step 406. In Step 408, a decision is given whether the load is higher than a predetermined value Z or not. When the engine load is small, the quantity of the fuel supplied from the injector is small, so that the evaporative fuel affects an air-fuel ratio greatly. Therefore, the control valve 6 is closed in Step 412, thus terminating the flow. If the load is higher than the predetermined value Z, the process proceeds to Step 408.

In Step 408, a decision is made whether a $\lambda$ control quantity which is a correction parameter of a fuel supply quantity relating to an $O_2$ feedback is out of a predetermined range or not. If the $\lambda$ control quantity is not in the predetermined range, the control valve 6 is closed to have an optimum function of the $O_2$ feedback in Step 412, thus terminating the flow. If the $\lambda$ control quantity is not out of the predetermined range, the control valve 6 is opened, thus terminating the execution of this flow.

In the case where the control valve 6 is an ON-OFF valve, the control valve 6 is structured to be turned ON or OFF when 1 or 0 is written in the valve-2 register 35 respectively. In this case, the register 332 of the valve register 35 is not used but only the register 331 is used.

Figure 5:
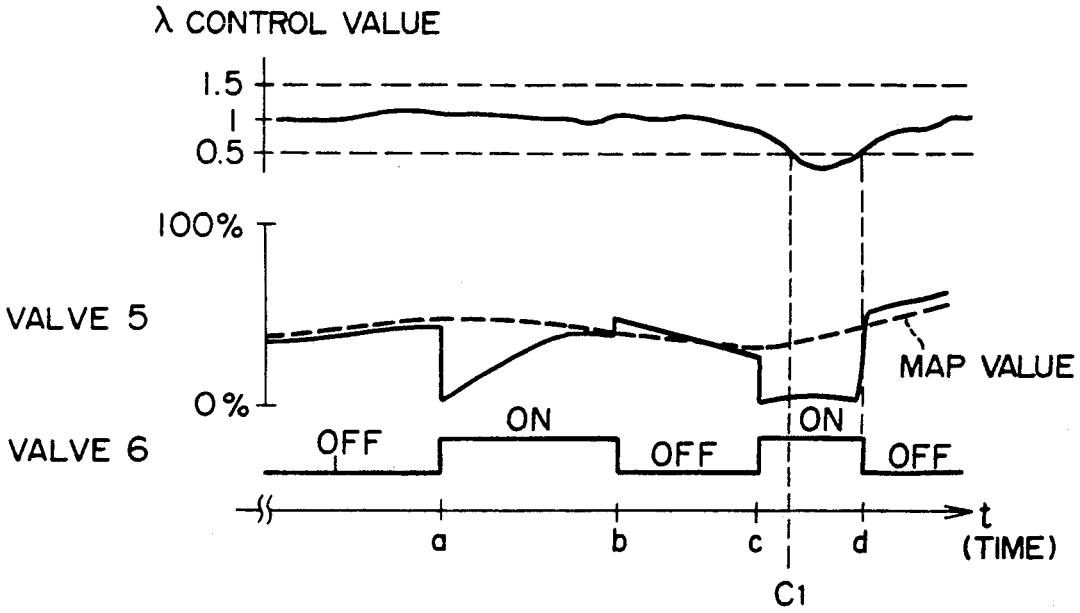
FIG. 5 is a time chart diagram for showing the operation of the first embodiment of the present invention.

The operations of the control valves 5 and 6 have been explained above with reference to the flow charts. These operations will be further explained with reference to a timing chart. Referring to FIG. 5, along the time scale from the start to a point a, the control valve 6 is in the closed state, while the control valve 5 changes in the $M_{AP}$ value in accordance with the state of the engine. Thereafter, when the control valve 6 changes from the closed state to an open state at a point of time a, the control valve 5 becomes in a completely closed state, when the duty is zero. Thereafter, the duty of the control valve 5 increases by $\alpha$ at each time to gradually reach the $M_{AP}$ value. After the duty of the control valve 5 has reached the $M_{AP}$ value and changed in the $M_{AP}$ value in accordance with the state of the engine, the control valve 6 changes from the open state to a closed state at a point of time b. Then, the duty of the control valve 5 is increased by $\gamma$ from the $M_{AP}$ value, thereafter reduced by $\alpha$ each time, to gradually reach the $M_{AP}$ value. When the duty of the control valve 5 has reached the $M_{AP}$ value, it changes in the $M_{AP}$ value in accordance with the state of the engine.

Further, when the control valve 6 changes from the closed state to an open state at a point of time c, the duty of the control valve 6 is set to zero and then gradually increased, in the similar manner as explained when the control valve 6 is at the point of time a. When the $\lambda$ control value is deviated from a predetermined range at the point of time $c_1$, the duty of the control valve 5 is gradually reduced by $\beta$ each time. When the control valve 6 changes from the open state to a closed state at a point of time d, the duty is increased by $\gamma$ from the $M_{AP}$ value, in the same manner as explained when the control valve 6 is at the point of time b. In the present embodiment, the control valve 5 may be ON-OFF controlled and the control valve 6 may be duty-controlled.

A second embodiment of the present invention will be explained next. The configuration of the second embodiment is the same as that of the first embodiment, except the control valves 5 and 6 are structured by duty control valves.

Figure 6:
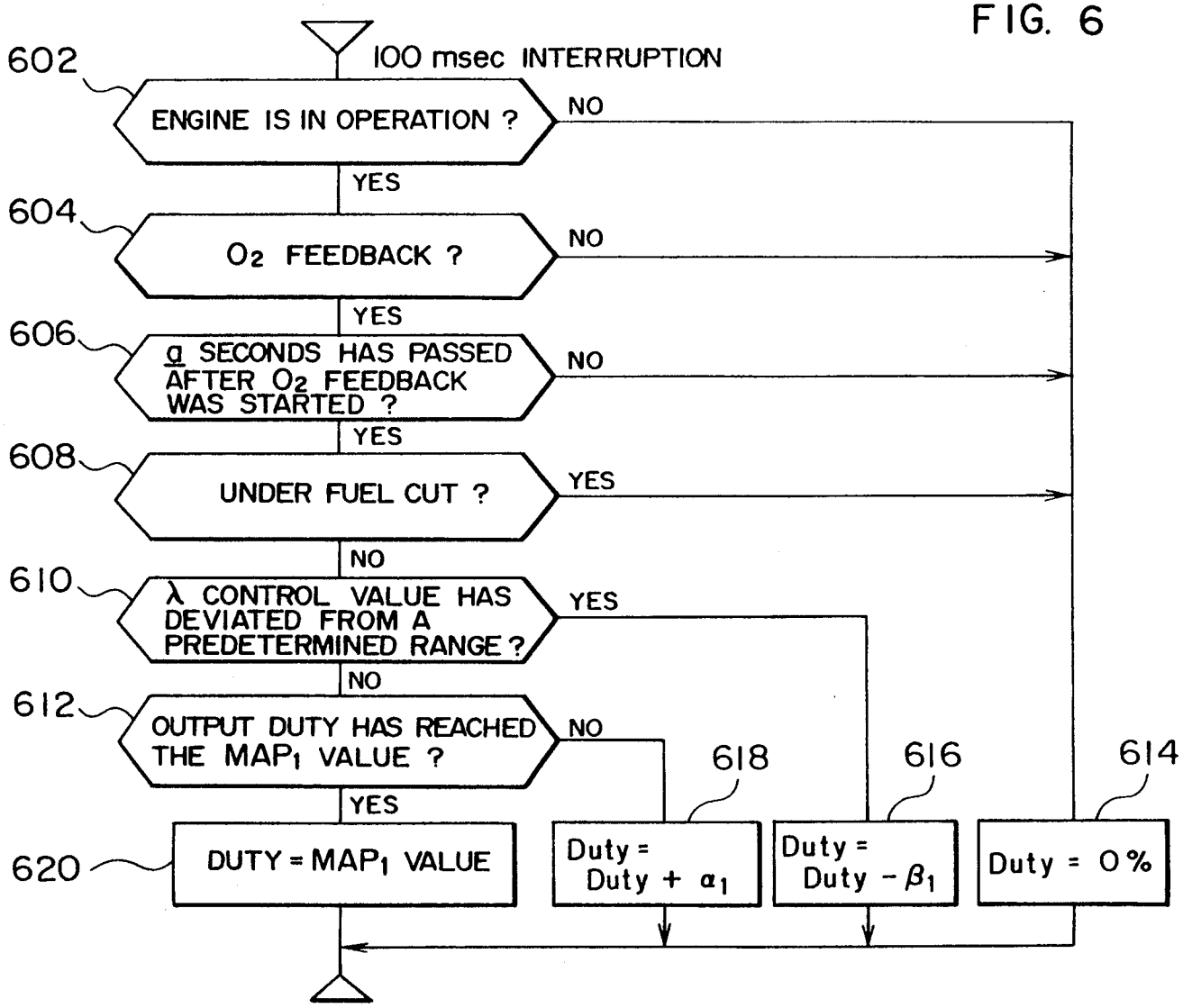
FIGS. 6 and 7 are flow chart diagrams for showing the operation of the second embodiment of the present invention.

Operation of the control valve 5 will be explained below with reference to the flow chart of FIG. 6. The operation shown in this flow chart is started at every 100 msec. In Step 602, a decision is made whether the engine is being operating or not. When the engine is not operating, it is not necessary to supply the fuel to the engine, so that the duty is set at zero to close the control valve 5 in Step 612, thus terminating the flow. When the engine is operating, the process proceeds to Step 604.

In Step 604, a decision is made whether an $O_2$ feedback is being carried out or not. If an $O_2$ feedback is not being carried out, a supply of the evaporative fuel changes an air-fuel ratio because of an open loop, so that the duty is set at zero to close the control value 5 in Step 614, thus terminating the flow. If an $O_2$ feedback is being carried out, the process proceeds to Step 606.

In Step 606, a decision is made whether a predetermined time (a seconds) has passed or not since the $O_2$ feedback was started. If a predetermined time has not passed since the starting of the $O_2$ feedback, the $O_2$ feedback control has not functioned satisfactorily, so that the duty is set at zero to close the control valve 5 in Step 614, thus terminating the flow. If a predetermined time has passed since the starting of the $O_2$ feedback, the process proceeds to Step 608.

In Step 608, a decision is made whether a fuel supply is being cut or not. If the supply of the fuel is being cut, it is not necessary to supply the fuel, so that the duty is set at zero to close the control valve 5 in Step 614, thus terminating the flow. If the supply of the fuel is not being cut, the process proceeds to Step 610.

In Step 610, a decision is made whether the λ control value is out of a predetermined range or not. If the λ control value is out of the predetermined range, the duty is reduced by a predetermined value $\beta_1$ to close the control valve 5 in order to reduce the quantity of the evaporative fuel in Step 616, thus terminating the flow. If the λ control value is not out of the predetermined range, the process proceeds to Step 612.

In Step 612, a decision is made whether an output duty has reached an $M_{AP1}$ value or not. If the output duty value has not reached the $M_{AP1}$ value, the duty has not returned to the $M_{AP1}$ value after it was set at zero in Step 614, so that the duty is increased by a predetermined value $\alpha_1$ to return the duty to $M_{AP1}$ thereby the gradually bring the duty of the control valve 5 to the $M_{AP}$ value in Step 618, thus terminating the flow. If the output duty has reached the $M_{AP1}$ value, the duty is set at the $M_{AP1}$ value in Step 620, thus terminating the flow. The $M_{AP1}$ value has been stored in advance in the ROM 27 in accordance with an engine speed and an engine load.

Figure 7:
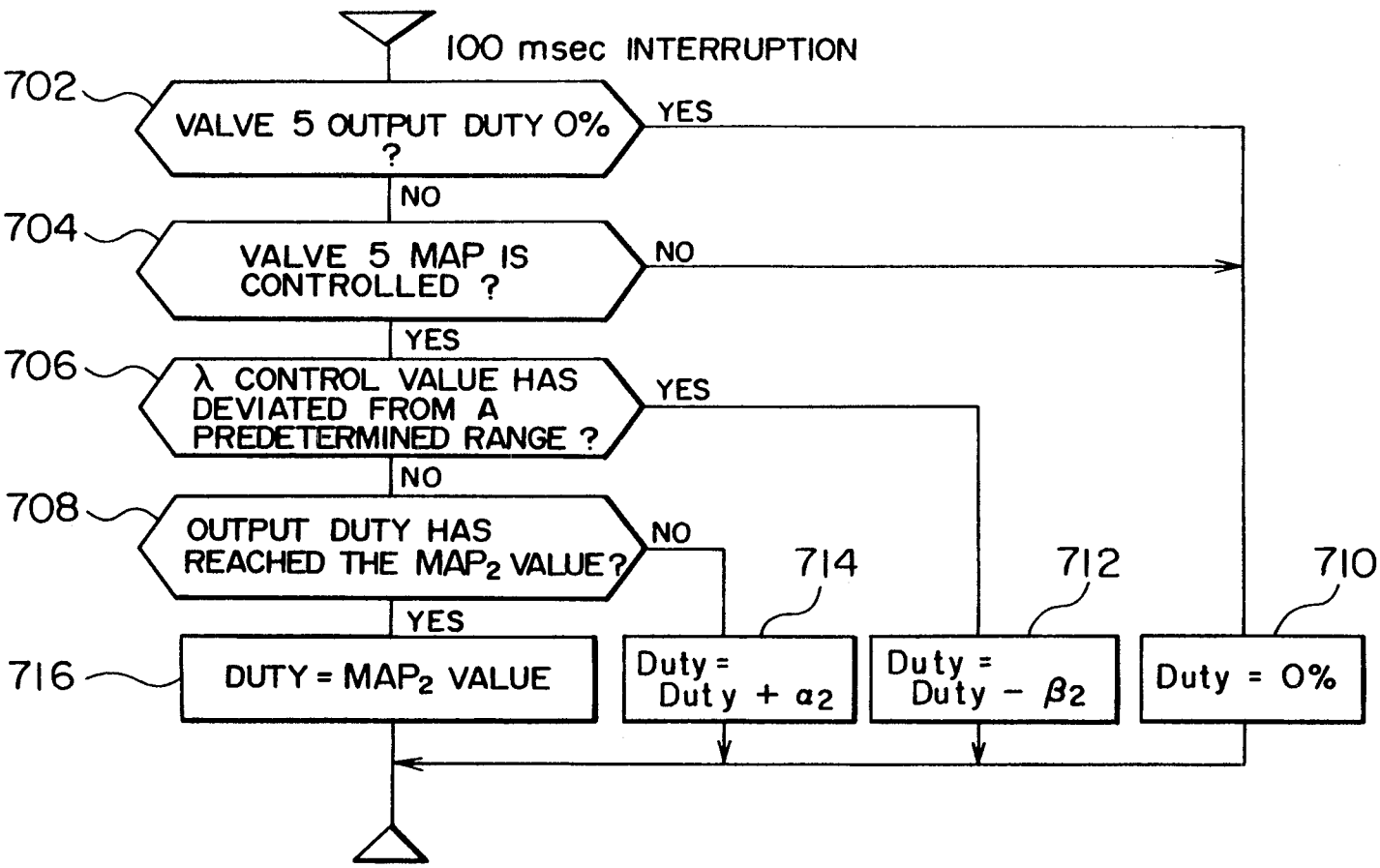

The operation of the control valve 6 will be explained below with reference to the flow chart in FIG. 7. First, in Step 702, a decision is made whether the output duty of the control valve 5 is zero or not. When the output duty of the control valve 5 is zero, the evaporative fuel should not be supplied in this state so that the duty is set at zero to close the control valve 6 in Step 710, thus terminating the flow.

In Step 704, a decision is made whether the duty of the control valve 5 is almost equal to $M_{AP1}$ or not. If the duty of the control valve 5 is not equal to $M_{AP1}$, the state is in a transient state so that the duty is set at zero to close the control valve 6 in Step 710, thus terminating the flow. If the duty of the control valve 5 is not almost equal to $M_{AP1}$, the process proceeds to Step 706.

In Step 706, a decision is made whether the λ control value is out of a predetermined range or not. If the λ control value is out of the predetermined range, the duty is reduced by a predetermined value $\alpha_2$ to close the control valve in order to reduce the quantity of the evaporative fuel in Step 712, thus terminating the flow. If the λ control value is not out of the predetermined range, the process proceeds to Step 708.

In Step 708, a decision is made whether the duty has reached an $M_{AP2}$ value or not. If the output duty has not reached the $M_{AP2}$ value, the duty is increased by a predetermined value $\alpha_2$ to gradually return the duty to the $M_{AP2}$ value in Step 714, thus terminating the flow. If the duty has reached the $M_{AP2}$ value, the duty is set at the $M_{AP2}$ value in Step 716, thus terminating the flow.

The $M_{AP2}$ value has been stored in advance in the ROM 27 in accordance with an engine speed and an engine load. The value of $M_{AP2}$ is different from the values of $M_{AP1}$ and $M_{AP2}$ that have been stored.

As described above, according to the present invention, it is possible to restrict a variation of the quantity of the evaporative fuel supplied from the first evaporative fuel pipe, by controlling the quantity of the evaporative fuel passing through the second evaporative fuel pipe, so that an overall variation of the quantity of the evaporative fuel discharged to the intake manifold can be minimized thereby to reduce the influence to the air-fuel ratio.

I claim:

1. A control system for an internal combustion engine comprising:

fuel tank;

a first and a second evaporative fuel routes for passing evaporative fuel from said fuel tank to an air intake path;

a first and a second control valves provided in said first and second evaporative fuel routes for controlling the quantity of evaporative fuel passing therethrough;

first control quantity determination means for determining a first control quantity for controlling said first control valve on the basis of the state of operating the engine; and second control quantity determination means for determining a second control quantity for controlling said second control valve on the basis of said first control quantity, wherein said second control quantity determination means includes means for determining that said second control quantity is reduced when said first control quantity has increased.

2. A control system for an internal combustion engine comprising:

fuel tank;

a first and a second evaporative fuel routes for passing evaporative fuel from said fuel tank to an air intake path;

a first and a second control valves provided in said first and second evaporative fuel routes for controlling the quantity of evaporative fuel passing therethrough;

first control quantity determination means for determining a first control quantity for controlling said first control valve on the basis of the state of operating the engine; and second control quantity determination means for determining a second control quantity for controlling said second control valve on the basis of said first control quantity, wherein said second control quantity determination means includes means for determining a second control quantity which causes the second control valve to be closed when a fuel supply quantity is not being feedback controlled so as to control an air-fuel ratio to be a target value.

3. A control system for an internal combustion engine comprising:

fuel tank;

a first and a second evaporative fuel routes for passing an evaporative fuel from said fuel tank to an air intake path;

a control valve provided in said first evaporative fuel route for continuously controlling an amount of the evaporative fuel passing therethrough;

a control valve for controlling opening and closing of a path provided in said second evaporative fuel route;

valve state determination means for determining whether said second control valve is to be in an open state or a closed state, in accordance with an operating state of the engine; and control quantity determination means for determining a control quantity of the first control valve in accordance with an open or closed state of said second control valve, wherein said control quantity determination means includes means for reducing said control quantity to a predetermined quantity when said second control valve has changed from a closed state to an open state.

4. A control system for an internal combustion engine comprising:

fuel tank;

a first and a second evaporative fuel routes for passing an evaporative fuel from said fuel tank to an air intake path;

a control valve provided in said first evaporative fuel route for continuously controlling an amount of the evaporative fuel passing therethrough;

a control valve for controlling opening and closing of a path provided in said second evaporative fuel route;

valve state determination means for determining whether said second control valve is to be in an open state or a closed state, in accordance with an operating state of the engine; and control quantity determination means for determining a control quantity of the first control valve in accordance with an open or closed state of said second control valve, wherein said control quantity determination means includes means for gradually increasing said control quantity after it has been reduced to a predetermined quantity.

5. A control system for an internal combustion engine comprising:

fuel tank;

a first and a second evaporative fuel routes for passing an evaporative fuel from said fuel tank to an air intake path;

a control valve provided in said first evaporative fuel route for continuously controlling an amount of the evaporative fuel passing therethrough;

a control valve for controlling opening and closing of a path provided in said second evaporative fuel route;

valve state determination means for determining whether said second control valve is to be in an open state or a closed state, in accordance with an operating state of the engine; and control quantity determination means for determining a control quantity of the first control valve in accordance with an open or closed state of said second control valve, wherein said control quantity determination means includes means for increasing said control quantity when said second control valve has changed from an open state to a closed state.

6. A control system for an internal combustion engine comprising:

fuel tank;

a first and a second evaporative fuel routes for passing evaporative fuel from said fuel tank to an air intake path;

a first and a second control valves provided in said first and second evaporative fuel routes for controlling the quantity of evaporative fuel passing therethrough;

first control quantity determination means for determining a first control quantity for controlling said first control valve on the basis of the state of operating the engine; and second control quantity determination means for determining a second control quantity for controlling said second control valve on the basis of said first control quantity, wherein said second control quantity determination means includes means for determining that said second control quantity is increased when said first control quantity has increased, and wherein said second control quantity is reduced when an air-fuel ratio is out of a predetermined state.

7. A control system for an internal combustion engine comprising:

a fuel tank;

a first and a second evaporative fuel routes for passing evaporative fuel from said fuel tank to an air intake path;

a first and a second control valves provided in said first and second evaporative fuel routes for controlling the quantity of evaporative fuel passing therethrough;

first control quantity determination means for determining a first control quantity for controlling said first control valve on the basis of the state of operating the engine; and second control quantity determination means for determining a second control quantity for controlling said second control valve on the basis of said first control quantity, wherein said second control quantity determination means includes means for increasing said second control quantity when said first control quantity has been reduced.

8. A control system for an internal combustion engine according to claim 1, wherein said second control quantity determination means further includes means for determining a second control quantity which causes the second control valve to be closed when the engine is not operating.

9. A control system for an internal combustion engine according to claim 2, wherein said second control quantity determination means includes further means for determining a second control quantity which causes said second control valve to be closed when a fuel supply is being cut.

10. A control system for an internal combustion engine according to claim 3, wherein said predetermined quantity is preset to a value at which said second control valve is closed.

11. A control system for an internal combustion engine according to claim 3, wherein said control quantity determination means includes further means for determining a control quantity of the first control valve on the basis of one of an engine speed and an engine load.

12. A control system for an internal combustion engine according to claim 1, wherein said second control quantity is increased when a supply of fuel is necessary.

* * * * *